US011090679B2

(12) United States Patent
Schumann et al.

(10) Patent No.: US 11,090,679 B2
(45) Date of Patent: Aug. 17, 2021

(54) APPARATUS FOR CONTROLLED APPLICATION OF A VISCOUS FLUID

(71) Applicant: The Boeing Company, Chicago, IL (US)

(72) Inventors: Robert James Schumann, Mount Pleasant, SC (US); Jonathan Christopher Heath, Summerville, SC (US)

(73) Assignee: The Boeing Company, Chicago, IL (US)

( * ) Notice: Subject to any disclaimer, the term of this patent is extended or adjusted under 35 U.S.C. 154(b) by 651 days.

(21) Appl. No.: 15/368,479

(22) Filed: Dec. 2, 2016

(65) Prior Publication Data

US 2018/0155093 A1 Jun. 7, 2018

(51) Int. Cl.

| | |
|---|---|
| ***B65D 47/20*** | (2006.01) |
| ***B05C 17/00*** | (2006.01) |
| ***B05C 17/005*** | (2006.01) |

(52) U.S. Cl.

CPC ..... *B05C 17/002* (2013.01); *B05C 17/00573* (2013.01)

(58) Field of Classification Search

CPC ... B05C 17/015; B05C 5/00; B05C 17/00573; B05B 12/002; F16K 21/04; F16N 13/16

USPC ..... 222/389, 325–327, 391

See application file for complete search history.

(56) References Cited

U.S. PATENT DOCUMENTS

| | | | | |
|---|---|---|---|---|
| 3,938,709 A * | 2/1976 | Collar | B05C 17/005 222/325 |
| 3,980,209 A * | 9/1976 | Collar | B05C 17/015 222/323 |
| 3,983,947 A * | 10/1976 | Wills | B05C 17/015 173/169 |
| 4,201,491 A | 5/1980 | Kohler | |
| 4,474,195 A | 10/1984 | Warner | |
| 4,762,433 A | 8/1988 | Bergeson et al. | |
| 5,018,894 A | 5/1991 | Goncalves | |

(Continued)

OTHER PUBLICATIONS

Cooper Industries, Chico Speed Seal Compound, May 23, 2015, Cooperindusties.com, pp. 10 and 11, Retrieved from: web.archive.org, Retrieved on: Jun. 22, 2018.*

(Continued)

*Primary Examiner* — Vishal Pancholi
*Assistant Examiner* — Robert K Nichols, II
(74) *Attorney, Agent, or Firm* — Kolisch Hartwell, P.C.

(57) ABSTRACT

Systems and methods for dispensing a viscous fluid using an apparatus that may include: a housing; an applicator coupling on the housing that can releasably couple an applicator that contains a viscous fluid; a gas supply coupling that receives a pressurized gas from a gas supply; a valve having a first open position in which the valve can be gradually and controllably opened to adjustably control the delivery of pressurized gas to the applicator coupling, and a second closed position where the pressurized gas delivered to the applicator coupling is vented; and a valve actuator configured to permit a user to gradually and controllably open the valve to controllably dispense the viscous fluid from the applicator, where ceasing to depress the valve actuator vents the applicator coupling and immediately discontinues the dispensing of viscous fluid from the applicator.

20 Claims, 8 Drawing Sheets

(56) References Cited

U.S. PATENT DOCUMENTS

| | | | | |
|---|---|---|---|---|
| 5,181,636 | A * | 1/1993 | Anderson | B05B 12/002 222/389 |
| 5,224,629 | A | 7/1993 | Hsich | |
| 5,597,255 | A | 1/1997 | Yager et al. | |
| 6,547,471 | B1 | 4/2003 | Tucker et al. | |
| 7,125,189 | B2 | 10/2006 | Gueret | |
| 7,232,273 | B2 | 6/2007 | Nealon et al. | |
| 7,390,533 | B2 | 6/2008 | Krueger | |
| 7,416,358 | B2 | 8/2008 | Legendre | |
| 8,585,309 | B2 | 11/2013 | Song | |
| 9,174,381 | B1 | 11/2015 | Morales | |

OTHER PUBLICATIONS

Adhesive Dispensing Ltd, Low Pressure Dispenser 0-15 psi TS255, product description page, retrieved from the internet at URL: http://www.adhesivedispensing.net/TS255_Dispenser_0_15_psi_p/ts255.html, on Sep. 27, 2016, 2 pages.

Delo, Delo-Xpress Pressure tanks and dispensing guns, product description page, retrieved from the internet at URL: https://www.delo-adhesives.com/en/adhesive-dispensing-system/delo-xpress-pressure-tank/, on Sep. 27, 2016, 1 page.

Jensen Global, Pneumatic Guns, product description page, retrieved from the Internet at URL: http://jensenglobal.com/products/pneumatic-guns, on Sep. 27, 2016, 1 page.

Pneumadyne, Inc., 2 & 3-Way Valves "200" & "300" Series, Catalog 2300, 2011, pp. 24-33.

* cited by examiner

APPARATUS FOR CONTROLLED APPLICATION OF A VISCOUS FLUID

FIELD

This disclosure relates to handheld applicators and methods of applying viscous fluids. More specifically, the disclosure relates to ergonomic and portable application apparatus for the application of lubricants, sealants, and adhesives.

INTRODUCTION

Many industrial manufacturing processes require the manual application of viscous fluids (or semi-solids) with some degree of precision.

Modern manufacturing often requires the manual application of adhesives, or the application of an appropriate sealant. In the aerospace industry, for example, there is a need to apply a sealant composition to the heads of exposed fasteners, or as protection at the rivet-skin interface in structures such as aircraft wings and fuselages, where the application of sealant may help prevent corrosive materials in the atmosphere from being drawn into and degrading the rivet or skin material adjacent the rivet. In many cases, the application of such sealants must be performed by hand.

From grease guns to tubes of silicon caulk, applicators for such substances are widely available, but they typically lack the required precision and control needed for such processes. Furthermore, the manual application of sealants and adhesives may be time-consuming, tedious, and messy, requiring awkward postures and strained positions in order to properly apply the desired fluid.

Although pneumatic dispensing guns exist, many employ an air-driven plunger that directly contacts the substance to be dispensed. This can create the potential for cross-contamination, as well as complicating the cleaning of the dispensing apparatus, particularly if the fluid being dispensed is a strong adhesive or sealant. Additionally, many such pneumatic dispensing guns are relatively large and relatively heavy, making them unsuitable for confined spaces, and making their use awkward or even harmful for long periods of use and/or repetitive movements.

What is needed is an apparatus that allows a user to apply a desired fluid precisely, quickly, and consistently, and that can apply such fluids to workpieces having differing geometries in accordance with the pertinent specification requirements, even in confined spaces.

SUMMARY

The present disclosure provides systems, apparatus, and methods relating to the application of viscous fluids.

In some embodiments, a hand-held apparatus for application of a viscous fluid may include a housing; an applicator coupling disposed on the housing and configured to releasably couple to an applicator that contains a viscous fluid; a gas supply coupling disposed on or within the housing, the gas supply coupling being configured to receive a pressurized gas from a gas supply; a valve disposed between and in fluid communication with both the gas supply coupling and the applicator coupling, the valve having a first open position in which a vent outlet is closed and the valve is configured so that the valve can be gradually and controllably opened to thereby adjustably control the delivery of the pressurized gas from a valve inlet to the applicator coupling, and a second closed position in which the valve inlet is closed and the vent outlet is open, such that when the valve is in the closed position the pressurized gas delivered to the applicator coupling is vented through the vent outlet; and a valve actuator operatively coupled with the valve, the valve actuator being configured to permit a user to adjustably depress the valve actuator to gradually and controllably open the valve and thereby to use the pressurized gas delivered to the applicator via the applicator coupling to controllably dispense the viscous fluid from the applicator, wherein ceasing to depress the valve actuator causes the valve to move to the closed position such that pressurized gas delivered to the applicator coupling is vented through the vent outlet, to thereby immediately discontinue dispense of viscous fluid from the applicator.

In some embodiments, a system for dispensing a viscous fluid may include a portable source of pressurized gas and a hand-held actuation apparatus connected to the source of pressurized gas via a hose; where the actuation apparatus includes a coupling configured to releasably retain an applicator that contains the viscous fluid and which includes a dispensing tip for the viscous fluid. The actuation apparatus may include a housing; a gas supply coupling disposed on or within the housing that is configured to receive the pressurized gas from the source of pressurized gas via the hose; a valve disposed between and in fluid communication with both the gas supply coupling and the applicator coupling, having a first open position in which a vent outlet is closed and the valve is configured so that the valve can be gradually and controllably opened to thereby adjustably control the delivery of the pressurized gas from a valve inlet to the applicator coupling, a second closed position in which the valve inlet is closed and the vent outlet is open, such that when the valve is closed the pressurized gas delivered to the applicator coupling is vented through the vent outlet; and a valve actuator operatively coupled with the valve and configured to permit a user to adjustably depress the valve actuator to gradually and controllably open the valve and thereby to use the pressurized gas delivered to the applicator via the applicator coupling to controllably dispense the viscous fluid from the applicator, where ceasing to depress the valve actuator causes the valve to move to the closed position such that pressurized gas delivered to the applicator coupling is vented through the vent outlet, to promptly discontinue dispense of viscous fluid from the applicator.

In some embodiments, a method of applying a viscous fluid to a workpiece, may include coupling an applicator to an applicator coupling disposed on a housing of a hand-held dispensing apparatus, where the applicator contains the viscous fluid and a dispensing tip for the viscous fluid; coupling a pressurized gas supply to a gas supply coupling disposed on or within the housing, where the housing includes a valve disposed between and in fluid communication with both the gas supply coupling and the applicator coupling, the valve having a first open position in which a vent outlet is closed and the valve is configured so that the valve can be gradually and controllably opened to thereby adjustably control the delivery of the pressurized gas to the applicator coupling, and a second closed position in which the valve inlet is closed and the vent outlet is open, such that when the valve is closed the pressurized gas delivered to the applicator coupling is vented to the vent outlet; engaging a valve actuator operatively coupled with the valve, where the valve actuator is configured to gradually and controllably open the valve so that the pressurized gas delivered to the applicator via the applicator coupling controllably dispenses the viscous fluid from the applicator; applying the viscous fluid to the workpiece; and disengaging the valve actuator to cause the valve to move to the closed position such that pressurized gas delivered to the applicator coupling is vented through the vent outlet, to promptly discontinue dispensing of viscous fluid from the applicator to the workpiece.

Features, functions, and advantages may be achieved independently in various embodiments of the present disclosure, or may be combined in yet other embodiments, further details of which can be seen with reference to the following description and drawings.

DESCRIPTION

Various embodiments of systems, apparatus, and methods relating to the application of viscous fluids are described below and illustrated in the associated drawings. Unless otherwise specified, an applicator apparatus, application system, or a method of applying a viscous fluid system and/or their various components may, but are not required to, contain at least one of the structure, components, functionality, and/or variations described, illustrated, and/or incorporated herein. The following description of various embodiments is merely exemplary in nature and is in no way intended to limit the disclosure, its application, or uses. Additionally, the advantages provided by the embodiments, as described below, are illustrative in nature and not all embodiments provide the same advantages or the same degree of advantages.

Figure 1:
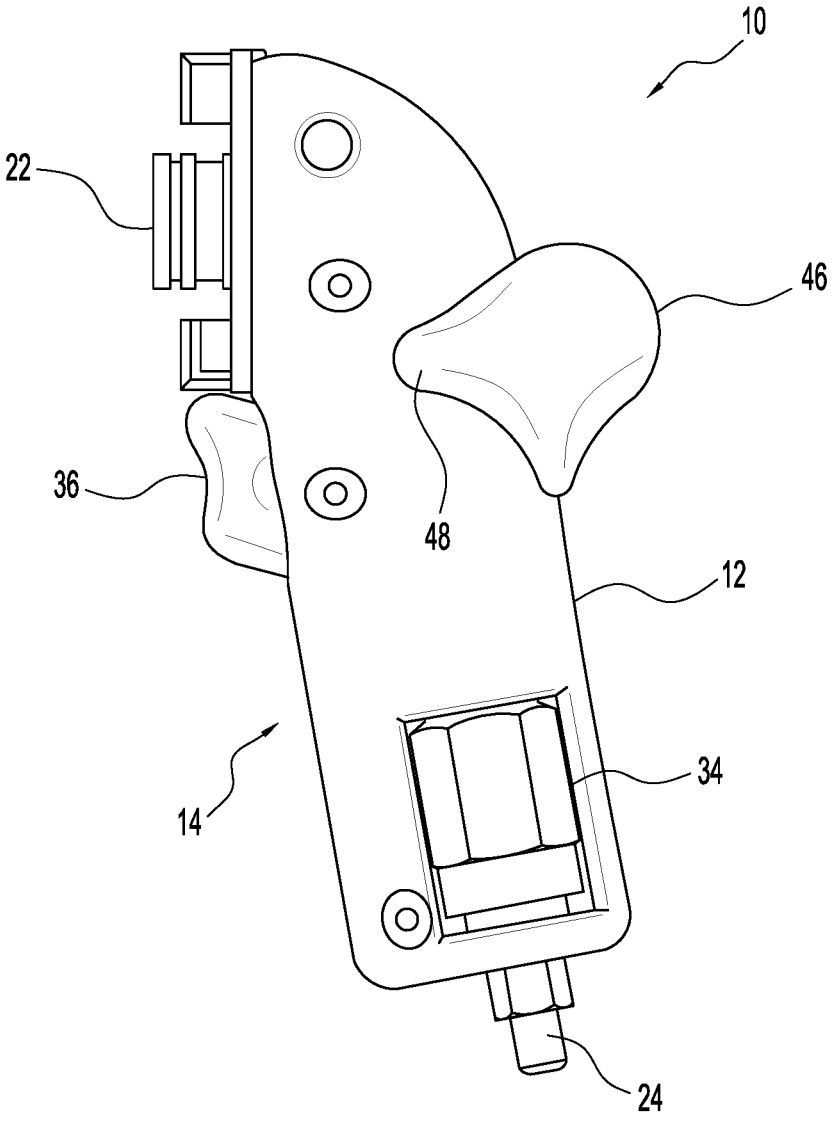
FIG. 1 depicts an illustrative apparatus for the application of a viscous fluid in accordance with aspects of the present disclosure.

An illustrative embodiment of the disclosed apparatus 10 for application of a viscous fluid is shown in FIG. 1. The apparatus may be configured to be portable, and in particular may be configured to be hand-held. The apparatus 10 may include an apparatus housing 12, which may include a portion configured to be used as a handgrip 14. The housing 12 may enclose or include a variety of connections to facilitate the application of the desired viscous fluid 16.

The viscous fluid 16 may be any fluid that lends itself to application via a pneumatic applicator, such as for example a lubricant, a sealant, or an adhesive, among others. The viscous fluid 16 may have any of a wide range of viscosities, provided that the viscous fluid 16 lends itself to application under pneumatic pressure, that is, it is fluid enough to flow under moderate air pressure, but not so fluid as to run freely from the applicator, or to migrate away from the point of application.

Where the viscous fluid 16 includes a lubricant, the lubricant may be a lubricant derived from crude oil or other petroleum feedstock, a biolubricant derived from vegetable sources, or a synthetic lubricant. A variety of lubricants are commercially available that are formulated to possess particular characteristics and that may be useful for selected applications.

Where the viscous fluid 16 includes a sealant, the sealant may include any suitable liquid composition that is curable and that will provide a desired protective coating. A variety of sealants and primers are commercially available. In a particular aspect of the disclosure, the sealant may incorporate a polysulfide, polythioether, and/or polyurethane formulation, and may optionally further include one or more corrosion inhibitors, such as for example dichromate. The sealant may require preparation before it can be applied, such as for example by mixing two or more components to form the curable sealant formulation. In one aspect of the disclosure, the sealant may be a silicone rubber, including two-component curable silicone rubbers, such as for example RTV Silicone.

Where the viscous fluid 16 includes an adhesive, the adhesive may be any suitable composition formulated to be applied to the surface of one or more items to bind them together so that they resist separation. The adhesive may be selected to harden by drying (such as solvent-based adhesives), or be a contact adhesive (such as elastomer-based adhesives), a multi-part adhesive (such as acrylics, urethanes, and epoxies, among others), or a curable adhesive (such as UV-curable, heat-curable, or moisture-curable adhesives), among others. The adhesive may require preparation before it can be applied, such as for example by mixing two or more components, such as a catalyst or other curative, to form the desired adhesive.

Figure 2:
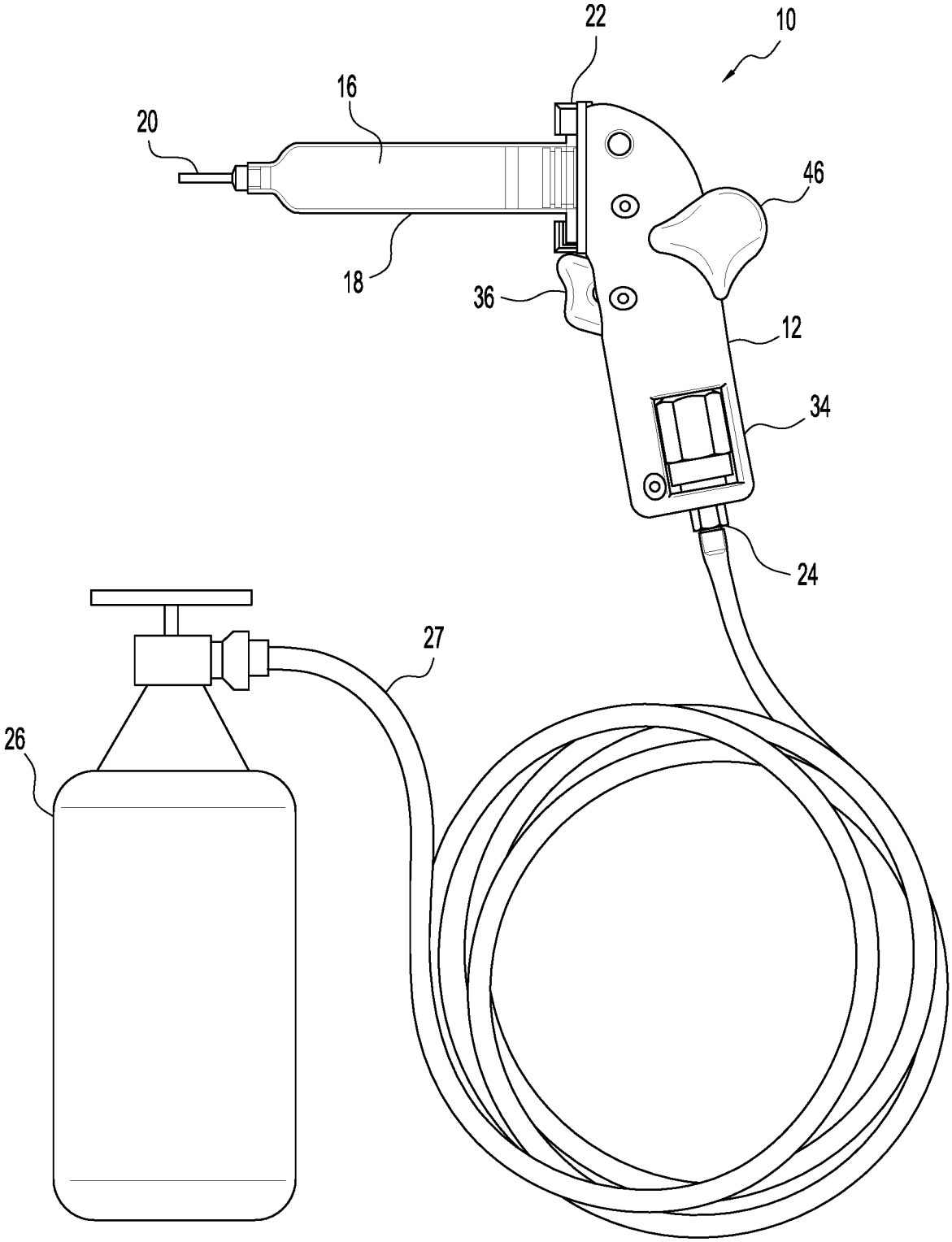
FIG. 2 depicts an illustrative system for the application of a viscous fluid that incorporates the apparatus of FIG. 1, in accordance with aspects of the present disclosure.

The apparatus 10 may be configured to dispense the desired viscous fluid 16 from an applicator 18, which may incorporate an applicator tip 20, as shown in FIG. 2. The applicator 18 may be commercially available, and may come preloaded with the desired fluid 16, or be filled from a fluid supply by the user. The apparatus 10 may include an applicator coupling 22 that may be configured to releasably couple to applicator 18. That is, the apparatus 10 may include a coupling 22 that may reversibly secure and retain an applicator 18, and form an air-tight seal with the applicator 18. A variety of applicator types and applicator coupling types may be suitable for use in conjunction with the disclosed apparatus. In one aspect of the disclosed apparatus, as shown in FIG. 2, the applicator 18 may correspond to or include a syringe, and the applicator coupling 22 may be correspond to an coupling configured to secure the desired syringe.

For example, the applicator 18 may incorporate a syringe, or syringe barrel which may be releasably coupled to applicator 18 by any appropriate and airtight fitting. For example, the applicator 18 may be coupled to housing 12 via a bayonet coupling, a Luer lock coupling, or a coupling that secures the syringe by interacting with a flange at the base of the syringe, among other types of couplings.

Similarly, the applicator tip 20 may have any suitable design, provided that the applicator tip 20 is configured to dispense the desired viscous fluid 16. For example, the applicator type may incorporate plastic- or metal-walled passages that permit the desired flow rate and flow volume of the viscous fluid 16. The applicator tip 20 may incorporate a nozzle, needle, or cannula, among others, which may be permanently bonded to the applicator, or which may be removable and replaceable. Where the applicator 18 is a syringe, the applicator tip 20 may be configured to be reversibly coupled to the applicator 18 via a conventional fitting, such as a Luer lock fitting.

The apparatus 10 may further include a gas supply coupling 24, that may be disposed on or within the housing. The gas supply coupling 24 may be configured to receive a pressurized gas from an external gas supply 26. Where the pressurized gas is delivered by an appropriate hose 27, the gas supply coupling 24 may include a hose fitting sized to couple with the hose 27.

The external gas supply 26 may be any suitable source of pressurized gas. For example, the external gas supply 26 may include a portable gas cylinder, a nonportable gas cylinder, a plumbed gas line, or a gas generator such as may be used to create a gas on demand from a solid or liquid source. Typically the external gas supply 26 may include a portable gas cylinder or a plumbed gas line, but the combination of the apparatus 10 of the present disclosure with a portable gas supply may offer particular advantages. For example, where a portable gas cylinder is suitable compact and light, the portable gas cylinder may be coupled directly to the gas supply coupling. Similarly, the source of pressurized gas may include a compressed gas cartridge, such as a nitrogen or compressed air cartridge, which may be attached directly to the gas supply coupling 24 as appropriate for smaller and/or shorter jobs.

Figure 3:
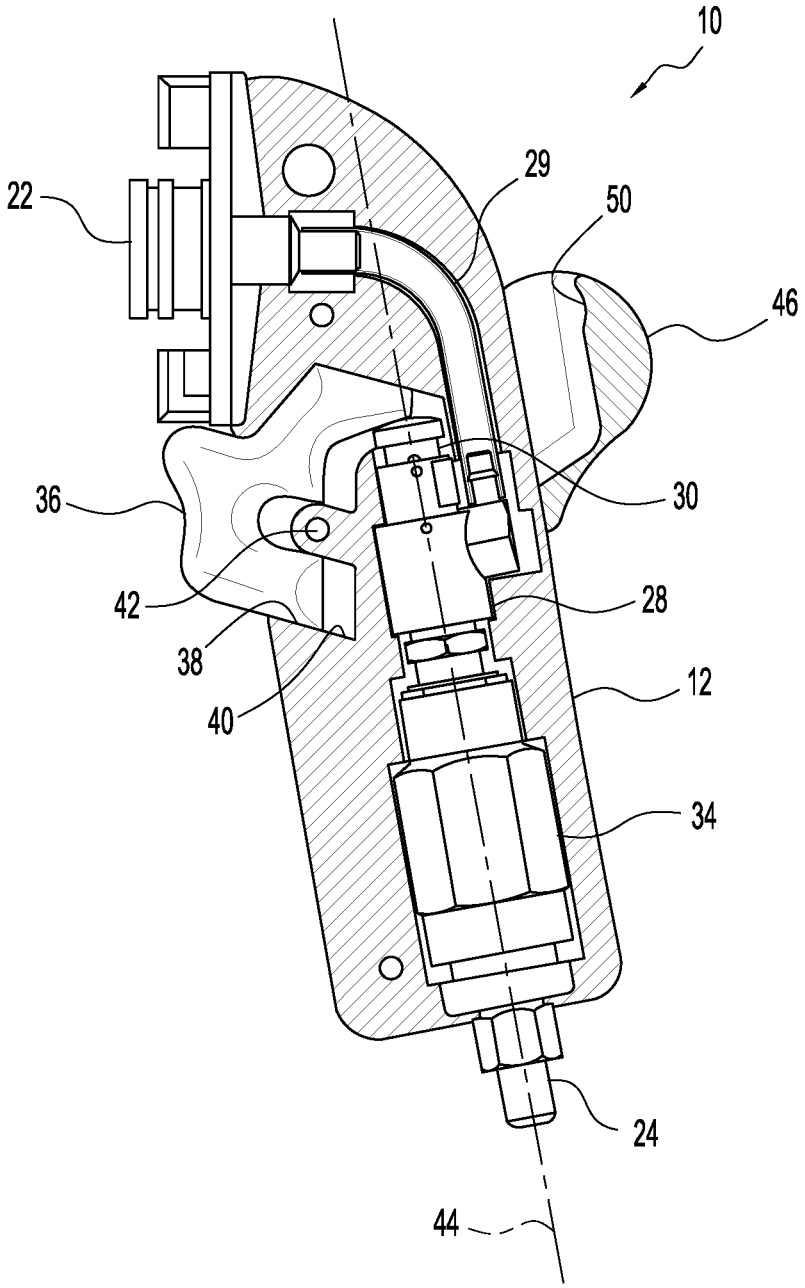
FIG. 3 is a vertical cross-section of the apparatus of FIG. 1.

As shown in cross-section in FIG. 3, the apparatus 10 may further include a valve 28 that may be partially or substantially enclosed by the housing 12. Valve 28 may be configured so that it is substantially interposed between the gas supply coupling 24 and the applicator coupling 22, and may be in fluid communication with both the gas supply coupling 24 and the applicator coupling 22. That is, an airtight conduit may connect the gas supply coupling 24 to the valve 28, and an airtight conduit may connect the valve 28 to the applicator coupling 22. The airtight conduit may be a direct connection, or may incorporate a discrete conduit, such as tubing 29. Valve 28 additionally includes or is in fluid communication with a vent that is open to the ambient environment.

Figure 4:
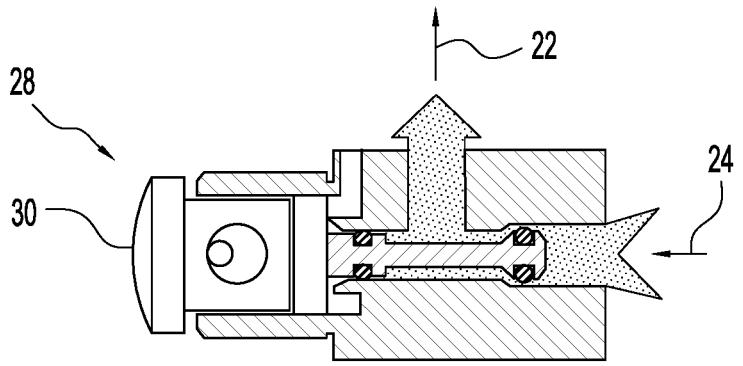
FIG. 4 is a schematic depiction of a three-way valve appropriate for selected apparatus of the present disclosure, in an open position.
Figure 5:
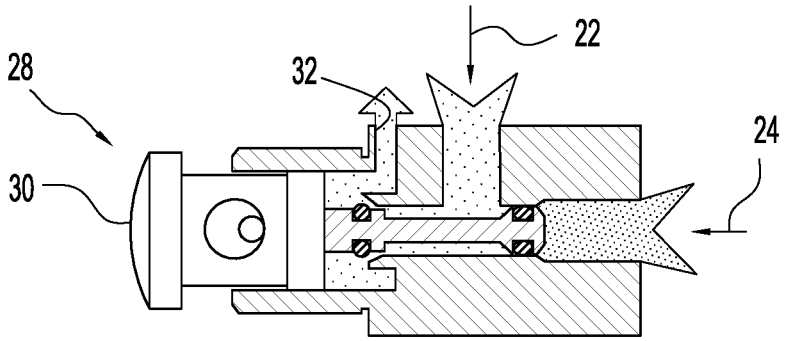
FIG. 5 is a schematic depiction of the three-way valve of FIG. 4, in a closed position.

As shown in FIGS. 4 and 5, valve 28 may be configured so that it has a first operating position, and a second operating position. When valve 28 is in the first operating position, a valve actuator 30 may be in an operative position, such as the button valve actuator 30 in FIG. 4 which is depressed. When the valve actuator 30 is in an operative position, the valve 28 may create a fluid connection between the gas supply coupling 24 and the applicator coupling 22. Typically, the valve actuator 30 may be gradually operated, so that valve 28 may be gradually and controllably opened to adjustably control a delivery of pressurized gas received from the gas supply coupling 24 to the applicator coupling 22. In this way, the flow of pressurized air being delivered to the applicator 18 can be controlled, and the viscous fluid 16 can be dispensed from the applicator tip 20. However, when valve 28 is in the second operating position, as shown in FIG. 5, the valve actuator 30 is in a non-operative position and the connection between the gas supply coupling 24 and the applicator coupling 22 is sealed. Instead, when valve 28 is in the closed position, the applicator coupling 22 is placed in fluid communication with a vent outlet 32, resulting in any pressurized gas in the applicator coupling 22 being immediately vented, and the delivery of viscous fluid 16 from the applicator 18 may be immediately terminated.

In operation, therefore, by gradual operation of the valve 28 the operator of the apparatus 10 may dispense the viscous fluid 16 with enhanced control over the rate of dispensation, and still terminate the flow of fluid immediately by closing valve 28. Appropriate valves for the apparatus of the present disclosure may be obtained from PNEUMADYNE, INC (Plymouth, Minn.).

In order to control the pressure of the gas being delivered to valve 28, a pressure regulator may be coupled with, or incorporated in, the gas supply 26. However, this configuration may require the operator to frequently return to the gas supply 26 in order to make any changes in operating pressure, such as fine-tuning the operating pressure at the apparatus 10. In an alternative embodiment of the apparatus 10, an inline regulator 34 may be disposed within housing 12 of apparatus 10, so that an adjustment of the inline regulator 34 may permit the pressure of the gas flowing from the gas supply coupling 24 to the applicator coupling 22 to be manually adjusted by the user without requiring the user to stop and travel to a regulator.

The apparatus 10 may further include a pressure indicator, such as a dial, in order to monitor and/or more precisely regulate the pressure of the gas being supplied to the applicator coupling 22. Such an indicator may be incorporated with the apparatus, for example as a component of inline regulator 34, or may be a component of an external source of pressurized gas, such as an external gas cylinder.

As discussed above, valve 28 may be adjustably controlled via a valve actuator 30, which is configured to allow a user to move valve 28 from its second operating position, in which no viscous fluid 16 is dispensed, to its first operating position, in which viscous fluid 16 may be controllably dispensed, in a straightforward and ergonomic manner. Any valve actuator 30 that permits the facile operation of valve 28 may be suitable valve actuator for the purposes of the present disclosure.

In one embodiment of the disclosed apparatus 10, the valve actuator 30 of valve 28 is operated by a depressable trigger member 36. As shown in FIG. 3, the depressable trigger member 36 may be disposed within and through a slot 38 defined in the housing 12. Trigger member 36 may be configured to cooperate with valve 28, so that depressing the trigger member 36 gradually opens valve 28 (corresponding to the first operating position), and releasing the trigger member 36 causes valve 28 to close (move to the second operating position) so that the pressurized gas is vented, and the fluid 16 immediately ceases to flow from the applicator 18.

The trigger member 36 may further be configured to translate along a specified path 40, as defined in part by slot 38 and optionally by one or more trigger guides 42. In this way the motion of the trigger member 36 is made more smooth, and the angle of the trigger member path 40 may be selected to enhance the ergonomics of the apparatus for a user. As shown in FIG. 3, the trigger member 36 may be configured to travel along a trigger member path 40 that is offset with respect to a longitudinal axis 44 of the housing 12. Trigger member 36, trigger member path 40, and trigger guide 42 may be configured to cooperate so that displacement of the trigger member 36 results in the operation of valve actuator 30.

Figure 6:
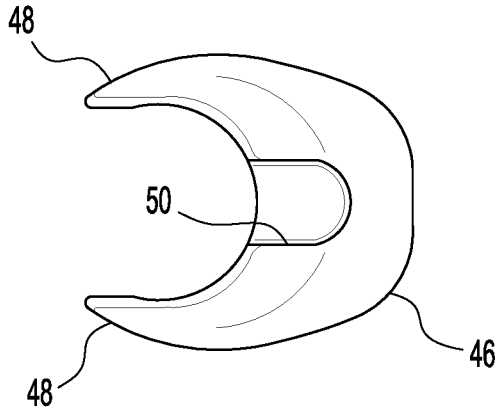
FIG. 6 is a top view of a support attachment in accordance with aspects of the present disclosure.
Figure 7:
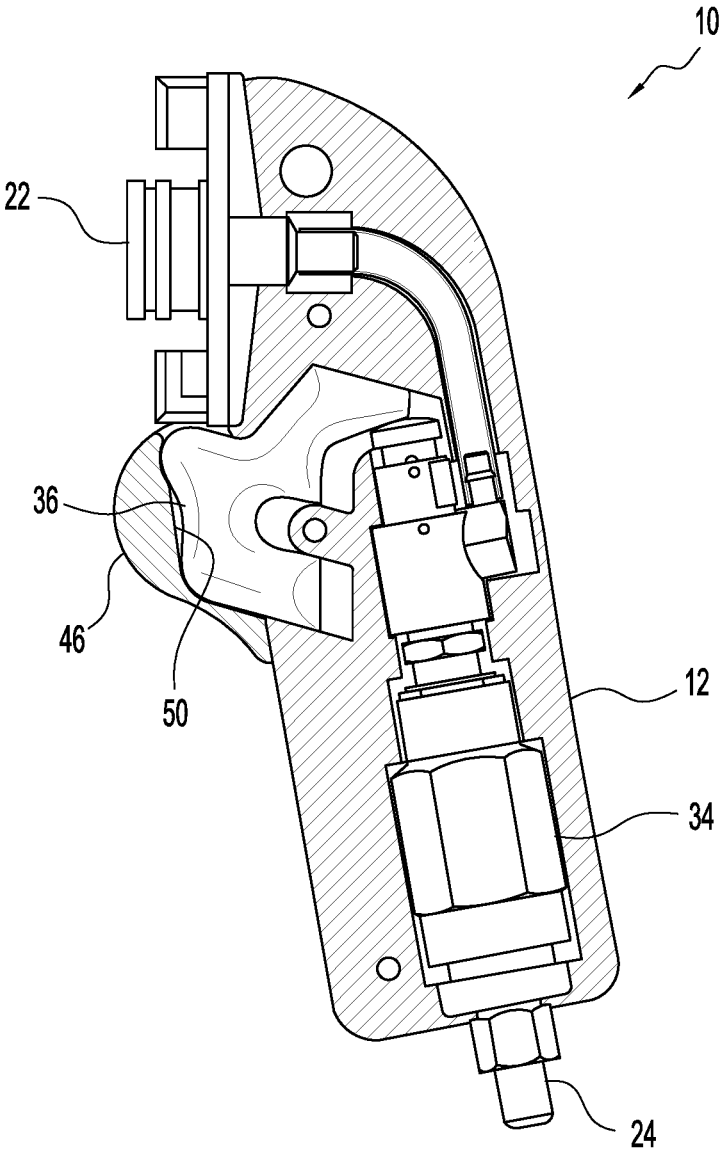
FIG. 7 is a vertical cross-section of the apparatus of FIG. 1, having a support attachment in an alternative configuration.
Figure 8:
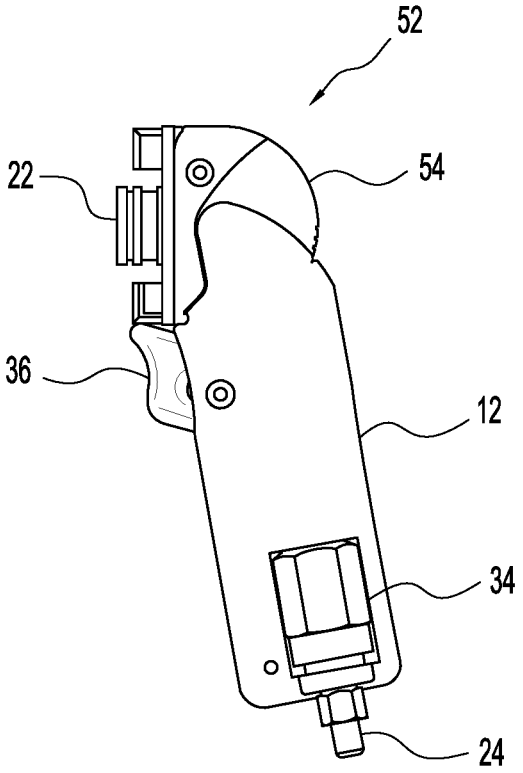
FIG. 8 is an alternative illustrative apparatus having an adjustable swivel head, the apparatus being in a pistol-grip configuration.
Figure 9:
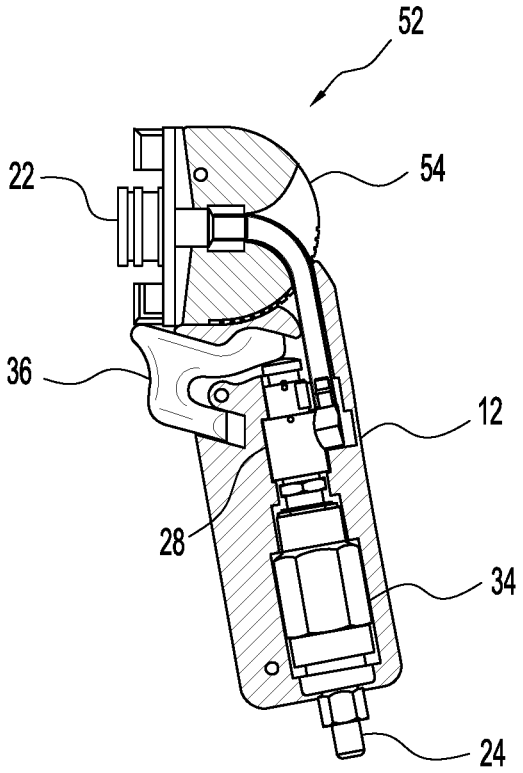
FIG. 9 is a cross-sectional view of the apparatus configuration of FIG. 8.

The ergonomics of apparatus 10 may be further enhanced by combination with an optional support attachment 46, as shown in FIGS. 1-3, 6, and 7. Support attachment 46 may be configured to attach to housing 12 via a pair of frictional clips 48 that are spaced so as to snugly accommodate the width of housing 12. In this way, the specific position of the support attachment 46 on the apparatus 10 may be varied according to user preference. When used, support attachment 46 may permit the weight of apparatus 10 to at least partially rest upon, and therefore be supported by, the hand of the user, and may be adjusted for hands of various sizes as well as the demands of an individual task, for example by accommodating an awkward angle or confined space. Additionally, as shown in FIGS. 3, 6, and 7, the support attachment 46 may incorporate an internal void 50 sized to accommodate the trigger member 36, so that the support attachment 46 can be positioned over the trigger member 36 and serve to prevent unintentional activation of apparatus 10, as shown in FIG. 7.

Figure 10:
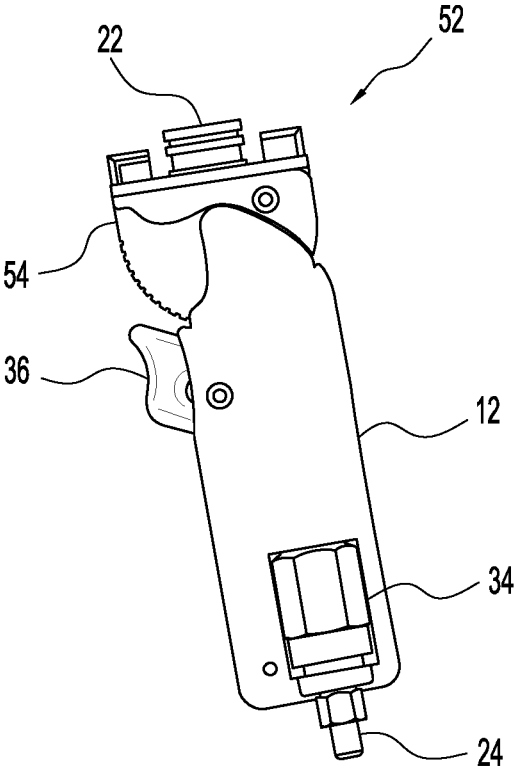
FIG. 10 is the illustrative apparatus of FIG. 8, the apparatus being in an alternative pen-type configuration.
Figure 11:
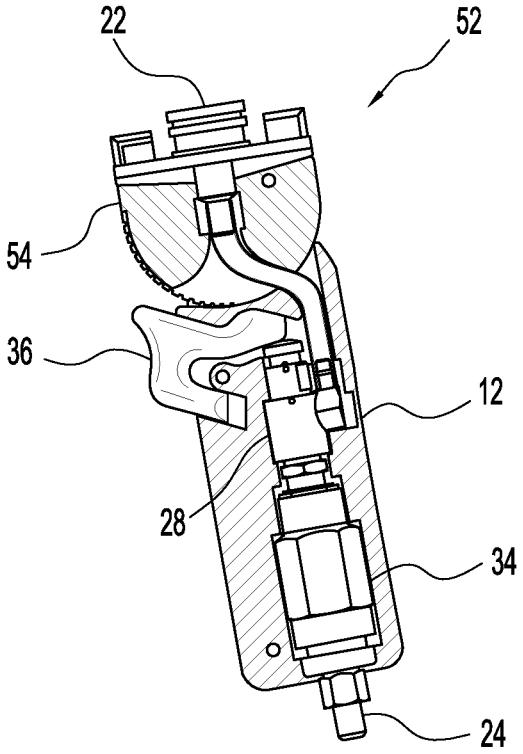
FIG. 11 is a cross-sectional view of the apparatus configuration of FIG. 10.

Alternatively, or in addition, the apparatus of the present disclosure may incorporated one or more mechanisms for adjusting the overall geometry of the apparatus. For example as shown in FIGS. 8-11, an illustrative apparatus 52 is shown that incorporates a swiveling head portion 54. The swiveling head portion 54 may be pivoted through a range of angles from a first configuration generally corresponding to a pistol-grip (FIGS. 8 and 9) to an inline configuration that is more linear and pen-like (FIGS. 10 and 11). The swiveling head portion 54 may be retained at one or more intermediate positions by locking at one of a plurality of detents. The geometry of the apparatus 52 may therefore be adjusted to conform to the ergonomic needs of an individual user, or the spatial demands associated with a specific job. In one aspect of the disclosed apparatus, the swiveling head portion 54 may have a resolution of approximately 2.3 degrees between adjacent detented positions.

Figure 12:
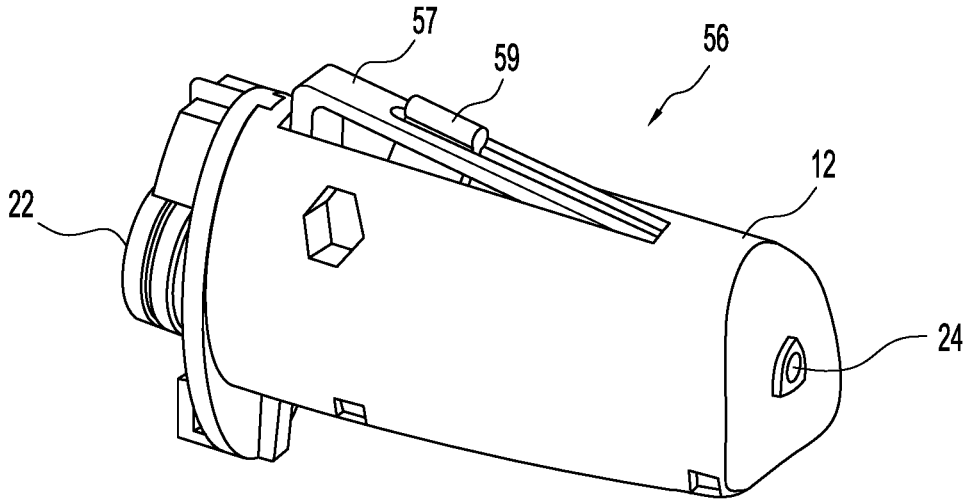
FIG. 12 depicts an alternative illustrative apparatus in accordance with aspects of the present disclosure.
Figure 13:
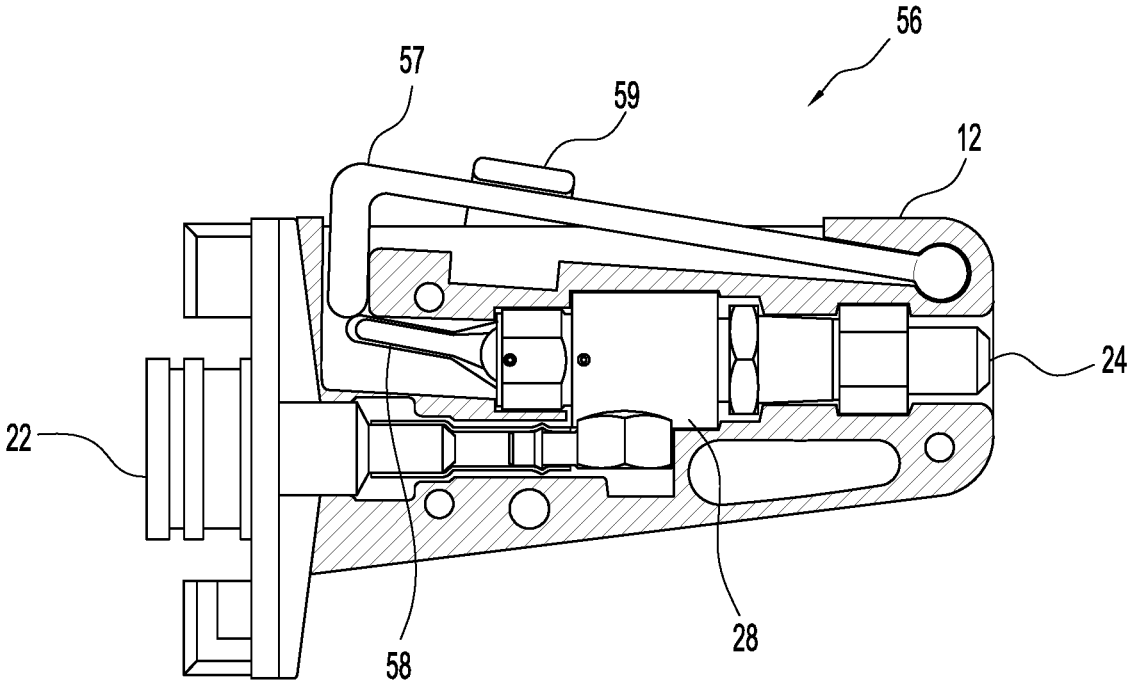
FIG. 13 is a cross-sectional view of the apparatus of FIG. 12

The apparatus of the present disclosure may optionally possess a more compact, inline design, as shown for apparatus 56 in FIGS. 12 and 13. Apparatus 56 may incorporate a housing 12, applicator coupling 22, gas supply coupling 24, and valve 28 arranged in a linear arrangement. Trigger member 57 of apparatus 56 may be configured to urge a valve actuator 58 into an operative position when depressed. As shown for apparatus 56, valve actuator 58 is a toggle actuator, and squeezing trigger member 57 results in the toggle being actuated. When toggle valve actuator 58 is gradually and controllably moved into an operative position, the valve 28 may create a fluid connection between the gas supply coupling 24 and the applicator coupling 22, and when valve actuator 58 is moved back to the non-operative position, the gas pressure between the valve 28 and the applicator coupling 22 is vented.

Additionally, apparatus 56 may incorporate a trigger lock 59 that can be engaged to lock the trigger member 57 in a depressed and operative position. The trigger lock 59 may be configured to lock the trigger member 57 only in a fully depressed position, or trigger lock 59 may optionally be configured to lock the trigger member 57 in one or more intermediate positions, so that the flow of viscous fluid 16 can be maintained at a desired rate without the user having to constantly hold the trigger member at a single position.

Figure 14:
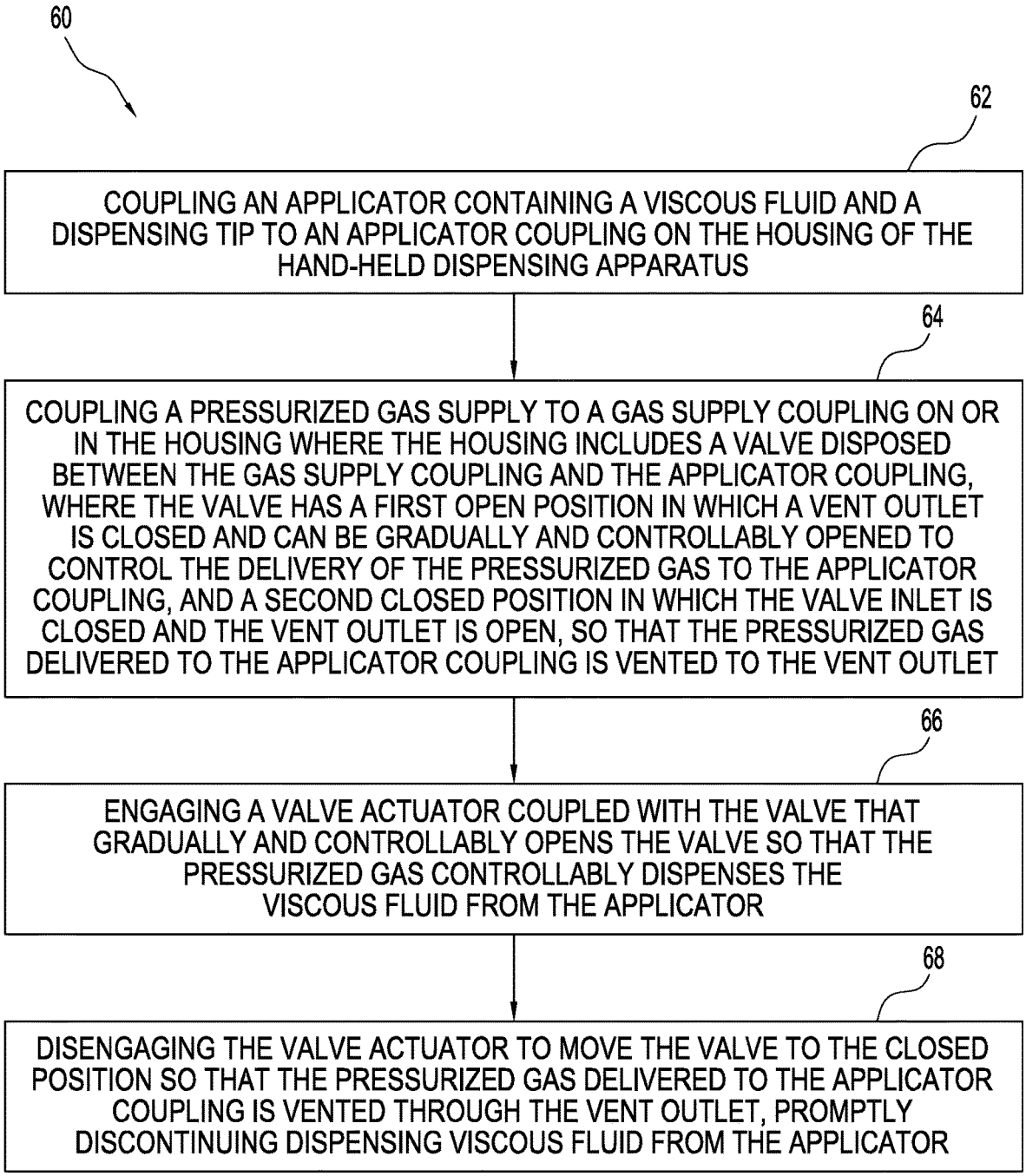
FIG. 14 is a flow chart depicting steps of a method for applying a viscous fluid to a workpiece, in accordance with aspects of the present disclosure

The apparatus of the present disclosure may lend themselves to a method of applying a viscous fluid to a workpiece, as shown in flowchart 60 of FIG. 14. The method may include coupling an applicator containing a viscous fluid and a dispensing tip to an applicator coupling on the housing of the hand-held dispensing apparatus, at 62 of flowchart 60; coupling a pressurized gas supply to a gas supply coupling on or in the housing, where the housing includes a valve disposed between the gas supply coupling and the applicator coupling, and where the valve has a first open position in which a vent outlet is closed and can be gradually and controllably opened to control the delivery of the pressurized gas to the applicator coupling, and a second closed position in which the valve inlet is closed and the vent outlet is open, so that the pressurized gas delivered to the applicator coupling is vented to the vent outlet, at 64 of flowchart 60; engaging a valve actuator coupled with the valve that gradually and controllably opens the valve so that the pressurized gas controllably dispenses the viscous fluid from the applicator, at 66 of flowchart 60; applying the viscous fluid to the workpiece, at 68 of flowchart 60; and disengaging the valve actuator to move the valve to the closed position so that the pressurized gas delivered to the applicator coupling is vented through the vent outlet, promptly discontinuing dispensing viscous fluid from the applicator, at 70 of flowchart 60.

Additional Selected Embodiments

This section describes additional aspects and features of the application apparatus, application systems, and methods of the present disclosure, presented without limitation as a series of paragraphs, some or all of which may be alphanumerically designated for clarity and efficiency. Each of these paragraphs can be combined with one or more other paragraphs, and/or with disclosure from elsewhere in this application, in any suitable manner. Some of the paragraphs below expressly refer to and further limit other paragraphs, providing without limitation examples of some of the suitable combinations.

A1. A hand-held apparatus for application of a viscous fluid, comprising:

a housing;

an applicator coupling disposed on the housing and configured to releasably couple to an applicator that contains a viscous fluid;

a gas supply coupling disposed on or within the housing, the gas supply coupling being configured to receive a pressurized gas from a gas supply;

a valve disposed between and in fluid communication with both the gas supply coupling and the applicator coupling, having a first open position in which a vent outlet is closed and the valve is configured so that the valve can be gradually and controllably opened to thereby adjustably control the delivery of the pressurized gas from a valve inlet to the applicator coupling, and a second closed position in which the valve inlet is closed and the vent outlet is open, such that when the valve is in the closed position the pressurized gas delivered to the applicator coupling is vented through the vent outlet; and a valve actuator operatively coupled with the valve, the valve actuator being configured to permit a user to adjustably depress the valve actuator to gradually and controllably open the valve and thereby to use the pressurized gas delivered to the applicator via the applicator coupling to controllably dispense the viscous fluid from the applicator, wherein ceasing to depress the valve actuator causes the valve to move to the closed position such that pressurized gas delivered to the applicator coupling is vented through the vent outlet, to thereby immediately discontinue dispensing viscous fluid from the applicator.

A2. The apparatus of paragraph A1, wherein the applicator for the viscous fluid includes a quantity of the viscous fluid within the applicator.

A3. The apparatus of paragraph A1, wherein the valve has a valve inlet, a vent outlet and a valve outlet in communication with the applicator coupling, and in the open position the valve inlet and valve outlet are open and the vent outlet is closed, and in the closed position the valve inlet is closed and the vent outlet and vent outlet are open.

A4. The apparatus of paragraph A3, wherein the applicator for the viscous fluid includes a syringe barrel and a dispensing tip.

A5. The apparatus of paragraph A1, further comprising an inline regulator disposed within the housing and configured to receive the pressurized gas from the gas supply coupling and to regulate a pressure of gas flowing from the inline regulator.

A6. The apparatus of paragraph A5, wherein the inline regulator is configured to be manually adjusted by a user.

A7. The apparatus of paragraph A1, further comprising an adjustable actuator lock configured to lock the valve actuator in a position that retains the valve in a partially open configuration.

A8. The apparatus of paragraph A1, wherein the valve actuator is a depressable trigger member, configured so that adjustably depressing the trigger member gradually opens the valve, and releasing the trigger causes the valve to move to the closed position such that pressurized gas delivered to the applicator coupling is vented through the vent outlet.

A9. The apparatus of paragraph A8, wherein depressing the trigger member displaces a valve stem of the valve and thereby adjustably opens the valve.

A10. The apparatus of paragraph A9, wherein the housing includes a slot therein in which the trigger member is disposed, the trigger member having a tapered end which, when the trigger member is adjustably depressed, adjustably displaces the valve stem of the valve.

B1. A system for dispensing a viscous fluid, comprising:

a portable source of pressurized gas; and a hand-held actuation apparatus connected to the source of pressurized gas via a hose; where the actuation apparatus includes a coupling configured to releasably retain an applicator that contains the viscous fluid and which includes a dispensing tip for the viscous fluid;

wherein the actuation apparatus includes:

a housing;

a gas supply coupling disposed on or within the housing, the gas supply coupling being configured to receive the pressurized gas from the source of pressurized gas via the hose;

a valve disposed between and in fluid communication with both the gas supply coupling and the applicator coupling, having a first open position in which a vent outlet is closed and the valve is configured so that the valve can be gradually and controllably opened to thereby adjustably control the delivery of the pressurized gas from a valve inlet to the applicator coupling, a second closed position in which the valve inlet is closed and the vent outlet is open, such that when the valve is closed the pressurized gas delivered to the applicator coupling is vented through the vent outlet; and a valve actuator operatively coupled with the valve, the valve actuator being configured to permit a user to adjustably depress the valve actuator to gradually and controllably open the valve and thereby to use the pressurized gas delivered to the applicator via the applicator coupling to controllably dispense the viscous fluid from the applicator, wherein ceasing to depress the valve actuator causes the valve to move to the closed position such that pressurized gas delivered to the applicator coupling is vented through the vent outlet, to promptly discontinue dispense of viscous fluid from the applicator.

B2. The system of paragraph B1, wherein the applicator includes a syringe that is loaded with a quantity of the viscous fluid.

B3. The system of paragraph B2, wherein the valve has a valve inlet, a vent outlet and a valve outlet in communication with the applicator coupling, and in the open position the valve inlet and valve outlet are open and the vent outlet is closed, and in the closed position the valve inlet is closed and the vent outlet and vent outlet are open.

B4. The system of paragraph B1, wherein the actuation apparatus further comprises an inline regulator disposed within the housing and configured to receive the pressurized gas from the gas supply coupling and to regulate a pressure of gas flowing from the inline regulator to the applicator.

B5. The system of paragraph B1, wherein the actuation apparatus further comprises an adjustable actuator lock configured to lock the valve actuator in a position that retains the valve in a partially open configuration.

B6. The system of paragraph B1, wherein the valve actuator is a depressable trigger member, configured so that adjustably depressing the trigger member gradually opens the valve, and releasing the trigger vents the applicator coupling causes the valve to move to the closed position such that pressurized gas delivered to the applicator coupling is vented through the vent outlet.

C1. A method of applying a viscous fluid to a workpiece, comprising: coupling an applicator to an applicator coupling disposed on a housing of a hand-held dispensing apparatus, wherein the applicator contains the viscous fluid and a dispensing tip for the viscous fluid; coupling a pressurized gas supply to a gas supply coupling disposed on or within the housing, wherein the housing includes a valve disposed between and in fluid communication with both the gas supply coupling and the applicator coupling, the valve having a first open position in which a vent outlet is closed and the valve is configured so that the valve can be gradually and controllably opened to thereby adjustably control the delivery of the pressurized gas to the applicator coupling, and a second closed position in which the valve inlet is closed and the vent outlet is open, such that when the valve is closed the pressurized gas delivered to the applicator coupling is vented to the vent outlet;

engaging a valve actuator operatively coupled with the valve, where the valve actuator is configured to gradually and controllably open the valve so that the pressurized gas delivered to the applicator via the applicator coupling controllably dispenses the viscous fluid from the applicator;

applying the viscous fluid to the workpiece; and disengaging the valve actuator to cause the valve to move to the closed position such that pressurized gas delivered to the applicator coupling is vented through the vent outlet, to to promptly discontinue dispensing of viscous fluid from the applicator to the workpiece.

C2. The method of paragraph C1, wherein engaging the valve actuator includes depressing a trigger member.

C3. The method of paragraph C1, wherein coupling the applicator to the applicator coupling includes attaching a syringe barrel containing the viscous fluid to an applicator coupling that is a complementary syringe coupling.

C4. The method of paragraph C1, wherein the viscous fluid is applied to a workpiece in a Class 1 Division 1 environment.

Advantages, Features, Benefits

The various embodiments of the systems, apparatus, and methods relating to the application of viscous fluids described herein may provide several advantages over previous systems and methods for applying such fluids. The compact nature of the apparatus, and its relative lightness, may permit one-handed operation by most users with less effort and less strain. Furthermore, the disclosed apparatus offers the ability to precisely vary the flow rate of the viscous fluid as it is being dispensed, rather than adjusting the volume of fluid being dispensed. The ability to precisely initiate and terminate the flow of fluid may create an enhanced degree of process control, and in turn enable an additional dimension of precision in tightly controlled processes, generally resulting in a cleaner and less wasteful application.

The disclosed apparatus is configured so that it may be capable of exchanging sources of pressurized gas, or the type of fluid being dispensed, without requiring a disassembly of the apparatus. In addition, by incorporating standardized connections, such as at the applicator coupling and/or gas supply coupling, the apparatus may be used in combination with a variety of commercially-available syringe-dispensable materials, and for the apparatus to be coupled to any of a variety of pressurized gas sources, making the apparatus highly versatile, backwards-compatible, and ideal for field operations.

The compact and self-contained nature of the disclosed apparatus, particularly when used in combination with a portable source of pressurized gas, also facilitates the application of sealants and adhesives in awkward or cramped environments, or where the presence or transportation of bulky regulators and metering equipment is less feasible.

Furthermore, as the operation of the disclosed apparatus is completely pneumatic, operation of the apparatus requires no electronics or other spark hazards, thereby permitting the use of the apparatus in classified environments, up to and including Class 1, Division 1 environments, where flammable vapors and gases may be present in ignitable concentrations.

As a result of the above advantageous characteristics, the implementation of the disclosed apparatus in industrial manufacturing processes may lead to both significant cost reductions in both material and work hours, and improved product quality. Additional cost savings may be obtained through the reduction of lost time due to enhanced safety and improved ergonomic factors.

Conclusion

While the systems, apparatus, and methods of applying a viscous fluid of the present disclosure been particularly shown and described with reference to preferred embodiments thereof, it will be understood by those skilled in the art that various other changes in the form and details may be made therein without departing from the spirit and scope of the invention. The foregoing description of the exemplary embodiments of the invention has been presented for purposes of illustration and description. It is not intended to be exhaustive or to limit the invention to the precise form disclosed. Man modifications and variations are possible in light of the above teaching. It is intended that the scope of the invention be limited not with this detailed description but rather by the claims appended hereto.

The subject matter of the invention(s) includes all novel and nonobvious combinations and subcombinations of the various elements, features, functions, and/or properties disclosed herein. The following claims particularly point out certain combinations and subcombinations regarded as novel and nonobvious. Invention(s) embodied in other combinations and subcombinations of features, functions, elements, and/or properties may be claimed in applications claiming priority from this or a related application. Such claims, whether directed to a different invention or to the same invention, and whether broader, narrower, equal, or different in scope to the original claims, also are regarded as included within the subject matter of the invention(s) of the present disclosure.

We claim:

1. A hand-held apparatus for application of a viscous fluid, comprising:

a housing;

an applicator coupling disposed on the housing and configured to releasably couple to an applicator that contains a viscous fluid, wherein the applicator for the viscous fluid includes a syringe barrel and a dispensing tip;

a gas supply coupling disposed on or within the housing, the gas supply coupling being configured to receive a pressurized gas from a gas supply;

a valve disposed between and in fluid communication with both the gas supply coupling and the applicator coupling, having a first open position in which a vent outlet is closed and the valve is configured so that the valve can be gradually and controllably opened to thereby adjustably control the delivery of the pressurized gas from a valve inlet to the applicator coupling, and a second closed position in which the valve inlet is closed and the vent outlet is open, such that when the valve is in the closed position the pressurized gas delivered to the applicator coupling is vented through the vent outlet; and a depressable trigger member operatively coupled with the valve, the depressable trigger member being configured to permit a user to adjustably depress the depressable trigger member to gradually and controllably open the valve and thereby to use the pressurized gas delivered to the applicator via the applicator coupling to controllably dispense the viscous fluid from the applicator, wherein ceasing to depress the depressable trigger member causes the valve to move to the closed position in which the valve inlet is closed and the vent outlet is open such that pressurized gas delivered to the applicator coupling is vented through the vent outlet, to thereby immediately discontinue dispense of viscous fluid from the applicator.

2. The apparatus of claim 1, wherein the applicator for the viscous fluid includes a quantity of the viscous fluid within the applicator.

3. The apparatus of claim 1, wherein the valve inlet, the vent outlet, and a valve outlet are in communication with the applicator coupling, and in the open position the valve inlet and valve outlet are open and the vent outlet is closed, and in the closed position the valve inlet is closed and the valve outlet and vent outlet are open.

4. The apparatus of claim 1, further comprising an inline regulator disposed within the housing and configured to receive the pressurized gas from the gas supply coupling and to regulate a pressure of gas flowing from the inline regulator.

5. The apparatus of claim 4, wherein the inline regulator is configured to be manually adjusted by a user.

6. The apparatus of claim 1, further comprising an adjustable trigger lock configured to lock the depressable trigger member in a position that retains the valve in a partially open configuration.

7. The apparatus of claim 1, wherein depressing the depressable trigger member displaces a valve stem of the valve and thereby adjustably opens the valve.

8. The apparatus of claim 7, wherein the housing includes a slot therein in which the depressable trigger member is disposed, the depressable trigger member having a tapered end which, when the depressable trigger member is adjustably depressed, adjustably displaces the valve stem of the valve.

9. A system for dispensing a viscous fluid, comprising:

a portable source of pressurized gas; and a hand-held actuation apparatus connected to the source of pressurized gas via a hose; where the actuation apparatus includes an applicator coupling configured to releasably retain an applicator that includes a syringe barrel that is loaded with a quantity of the viscous fluid and which includes a dispensing tip for the viscous fluid;

wherein the actuation apparatus includes:

a housing;

a gas supply coupling disposed on or within the housing, the gas supply coupling being configured to receive the pressurized gas from the source of pressurized gas via the hose;

a valve disposed between and in fluid communication with both the gas supply coupling and the applicator coupling, having a first open position in which a vent outlet is closed and the valve is configured so that the valve can be gradually and controllably opened to thereby adjustably control the delivery of the pressurized gas from a valve inlet to the applicator coupling, a second closed position in which the valve inlet is closed and the vent outlet is open, such that when the valve is closed the pressurized gas delivered to the applicator coupling is vented through the vent outlet; and a trigger operatively coupled with the valve, the trigger being configured to permit a user to adjustably depress the trigger to gradually and controllably open the valve and thereby to use the pressurized gas delivered to the applicator via the applicator coupling to controllably dispense the viscous fluid from the applicator, wherein ceasing to depress the trigger causes the valve to move to the closed position in which the valve inlet is closed and the vent outlet is open such that pressurized gas delivered to the applicator coupling is vented through the vent outlet, to promptly discontinue dispense of viscous fluid from the applicator.

10. The system of claim 9, wherein the valve inlet, the vent outlet and a valve outlet are in communication with the applicator coupling, and in the open position the valve inlet and valve outlet are open and the vent outlet is closed, and in the closed position the valve inlet is closed and the valve outlet and vent outlet are open.

11. The system of claim 9, wherein the actuation apparatus further comprises an inline regulator disposed within the housing and configured to receive the pressurized gas from the gas supply coupling and to regulate a pressure of gas flowing from the inline regulator to the applicator.

12. The system of claim 11, wherein the inline regulator is configured to be manually adjusted by a user.

13. The system of claim 9, wherein the actuation apparatus further comprises an adjustable trigger lock configured to lock the trigger in a position that retains the valve in a partially open configuration.

14. The system of claim 13, wherein the actuation apparatus further comprises an inline regulator disposed within the housing and configured to receive the pressurized gas from the gas supply coupling and to regulate a pressure of gas flowing from the inline regulator to the applicator.

15. The system of claim 9, wherein depressing the depressable trigger member displaces a valve stem of the valve and thereby adjustably opens the valve.

16. The system of claim 15, wherein the housing includes a slot therein in which the depressable trigger member is disposed, the depressable trigger member having a tapered end which, when the depressable trigger member is adjustably depressed, adjustably displaces the valve stem of the valve.

17. A method of applying a viscous fluid to a workpiece, comprising:

coupling an applicator to an applicator coupling disposed on a housing of a hand-held dispensing apparatus, wherein the applicator includes a syringe barrel that is loaded with the viscous fluid and a dispensing tip for the viscous fluid;

coupling a pressurized gas supply to a gas supply coupling disposed on or within the housing, wherein the housing includes a valve disposed between and in fluid communication with both the gas supply coupling and the applicator coupling, the valve having a first open position in which a vent outlet is closed and the valve is configured so that the valve can be gradually and controllably opened to thereby adjustably control the delivery of the pressurized gas to the applicator coupling, and a second closed position in which a valve inlet is closed and the vent outlet is open, such that when the valve is closed the pressurized gas delivered to the applicator coupling is vented to the vent outlet;

engaging a trigger member operatively coupled with the valve, where the trigger member is configured to gradually and controllably open the valve so that the pressurized gas delivered to the applicator via the applicator coupling controllably dispenses the viscous fluid from the applicator;

applying the viscous fluid to the workpiece; and disengaging the trigger member to cause the valve to move to the closed position in which the valve inlet is closed and the vent outlet is open such that pressurized gas delivered to the applicator coupling is vented through the vent outlet, to promptly discontinue dispensing of viscous fluid from the applicator to the workpiece.

18. The method of claim 17, wherein coupling the applicator to the applicator coupling includes attaching the syringe barrel containing the viscous fluid to an applicator coupling that is a complementary syringe coupling.

19. The method of claim 17, wherein the viscous fluid is applied to a workpiece in a Class 1 Division 1 environment.

20. The method of claim 17, wherein engaging the trigger member includes depressing the trigger member to displace a valve stem of the valve and thereby adjustably open the valve.

* * * * *